US009478197B2

(12) United States Patent
Lim et al.

(10) Patent No.: US 9,478,197 B2
(45) Date of Patent: Oct. 25, 2016

(54) ORGANIC LIGHT EMITTING DISPLAY WITH THRESHOLD VOLTAGE COMPENSATION AND METHOD FOR DRIVING THE SAME

(71) Applicant: LG Display Co., Ltd., Seoul (KR)

(72) Inventors: Yirang Lim, Gyeonggi-do (KR); Sangho Yu, Gyeonggi-do (KR); Munjun Lee, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 0 days.

(21) Appl. No.: 14/275,764

(22) Filed: May 12, 2014

(65) Prior Publication Data

US 2015/0049075 A1 Feb. 19, 2015

(30) Foreign Application Priority Data

Aug. 19, 2013 (KR) ..... 10-2013-0098118

(51) Int. Cl.
*G09G 3/32* (2016.01)
*G09G 5/397* (2006.01)

(52) U.S. Cl.
CPC ..... *G09G 5/397* (2013.01); *G09G 3/3233* (2013.01); *G09G 2300/0452* (2013.01); *G09G 2300/0842* (2013.01); *G09G 2320/0233* (2013.01); *G09G 2320/0295* (2013.01); *G09G 2320/043* (2013.01)

(58) Field of Classification Search
CPC ..... G09G 3/3258
USPC ..... 345/76, 212
See application file for complete search history.

(56) References Cited

U.S. PATENT DOCUMENTS

2008/0303754 A1* 12/2008 Murata ..... G09G 3/3233 345/76
2011/0227505 A1* 9/2011 Park ..... H05B 33/0896 315/297
2012/0081381 A1* 4/2012 Kobayashi ..... G09G 5/18 345/558
2013/0147690 A1* 6/2013 Kim ..... G09G 3/3233 345/76

FOREIGN PATENT DOCUMENTS

CN 101079233 A 11/2007
CN 101231816 A 7/2008
CN 102592538 A 7/2012
CN 103165078 A 6/2013

OTHER PUBLICATIONS

Chinese First Office Action, Chinese Application No. 201410283464.8, May 5, 2016, 17 pages.

* cited by examiner

*Primary Examiner* — Jonathan Blancha
(74) *Attorney, Agent, or Firm* — Fenwick & West LLP

(57) ABSTRACT

An organic light emitting display and a method for driving the same are disclosed. The organic light emitting display includes a display panel, a data driver supplying a data signal to the display panel, a memory which is positioned inside or outside the data driver and includes at least two banks, and a sensing circuit unit which measures a threshold voltage of at least one driving transistor included in the display panel and provides compensation data. The data driver separately writes and reads previous compensation data and new compensation data provided by the sensing circuit unit in the at least two banks of the memory.

10 Claims, 12 Drawing Sheets

ORGANIC LIGHT EMITTING DISPLAY WITH THRESHOLD VOLTAGE COMPENSATION AND METHOD FOR DRIVING THE SAME

This application claims the benefit of Korean Patent Application No. 10-2013-0098118 filed on Aug. 19, 2013, which is incorporated herein by reference for all purposes as if fully set forth herein.

BACKGROUND OF THE INVENTION

1. Field of the Invention

Embodiments of the invention relate to an organic light emitting display and a method for driving the same.

2. Discussion of the Related Art

An organic light emitting element used in an organic light emitting display is a self-emitting element having a light emitting layer between two electrodes. The organic light emitting element receives electrons and holes from a cathode serving as an electron injection electrode and an anode serving as a hole injection electrode and injects the electrons and the holes into the light emitting layer. The injected electrons and holes are combined to form an exciton. The organic light emitting element emits light when the exciton drops from an excited state to a ground state.

When a scan signal, a data signal, and a power source are supplied to a plurality of subpixels arranged in a matrix form, selected subpixels emit light. Hence, the organic light emitting display may display an image.

When the organic light emitting display is used for a long time, characteristics (including a threshold voltage, a current mobility, etc.) of a driving transistor included in each subpixel change. Therefore, life span of the organic light emitting element is reduced due to a reduction in a driving current over time. Various problems including a reduction in the life span of the organic light emitting element, etc. are required to be improved.

SUMMARY OF THE INVENTION

In one aspect, there is an organic light emitting display comprising a display panel, a data driver configured to supply a data signal to the display panel, a memory positioned inside or outside the data driver, the memory including at least two banks, and a sensing circuit unit configured to measure a threshold voltage of at least one driving transistor included in the display panel and provide compensation data, wherein the data driver separately writes and reads previous compensation data and new compensation data provided by the sensing circuit unit in the at least two banks of the memory.

In another aspect, there is a method for driving an organic light emitting display comprising supplying a data signal to a display panel and displaying an image on the display panel, measuring a threshold voltage of at least one driving transistor included in the display panel, providing compensation data, and separately writing and reading previous compensation data and new compensation data in at least two banks of a memory, and reading the previous compensation data and compensating for the data signal, which will be now supplied, during a period, in which the image is displayed on the display panel.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Exemplary embodiments will be described with reference to FIGS. 1 to 14.

Figure 1:
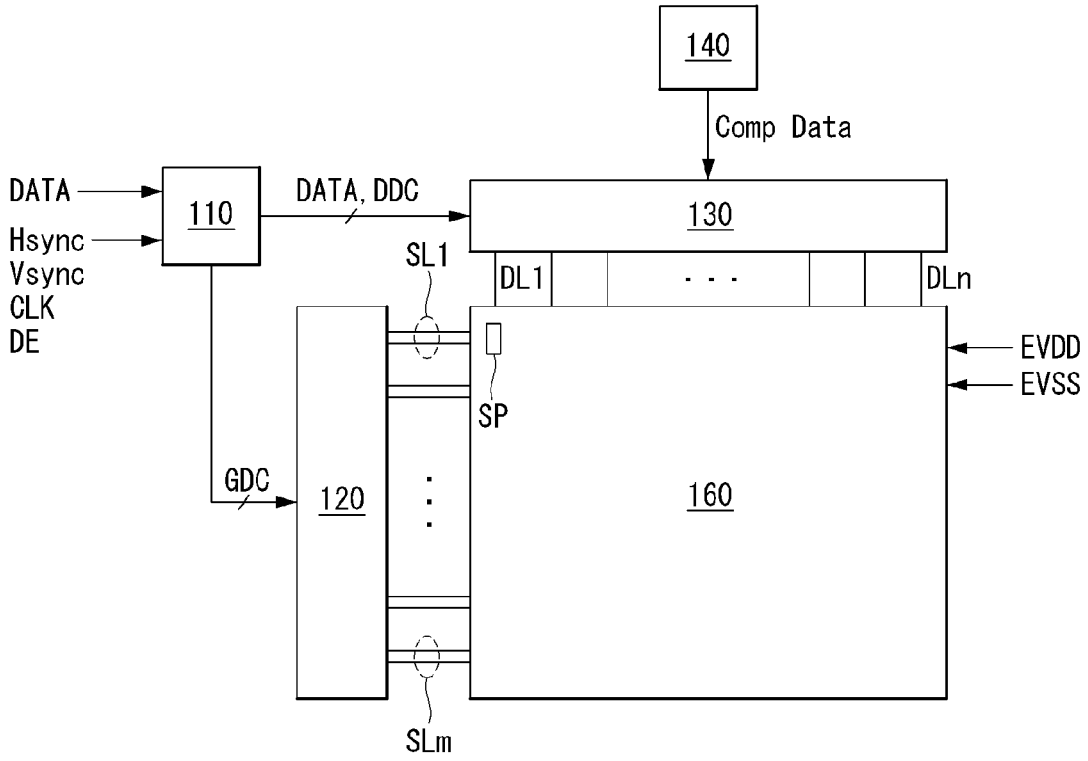
FIG. 1 shows an example of configuration of an organic light emitting display according to an exemplary embodiment of the invention.

FIG. 1 shows an example of configuration of an organic light emitting display according to an embodiment of the disclosure.

As shown in FIG. 1, the organic light emitting display according to the embodiment of the invention includes a timing controller 110, a scan driver 120, a data driver 130, a sensing circuit unit 140, and a display panel 160.

The timing controller 110 controls operation timings of the scan driver 120 and the data driver 130 using timing signals, such as a vertical sync signal Vsync, a horizontal sync signal Hsync, a data enable signal DE, and a clock CLK, received from the outside. Because the timing controller 110 may determine a frame period by counting the data enable signals DE of one horizontal period, the vertical sync signal Vsync and the horizontal sync signal Hsync received from the outside may be omitted. Control signals generated by the timing controller 110 include a gate timing control signal GDC for controlling operation timing of the scan driver 120 and a data timing control signal DDC for controlling operation timing of the data driver 130.

The scan driver 120 sequentially generates a scan signal while shifting a level of a gate driving voltage in response to the gate timing control signal GDC received from the timing controller 110. The scan driver 120 supplies the scan signal through scan lines SL1 to SLm connected to subpixels SP included in the display panel 160.

The data driver 130 samples and latches a data signal DATA supplied from the timing controller 110 in response to the data timing control signal DDC received from the timing controller 110 and converts the latched data signal DATA into data of a parallel data system. The data driver 130 converts the data signal DATA of digital type into the data signal DATA of analog type based on a gamma reference voltage. The data driver 130 supplies the data signal DATA through data lines DL1 to DLn connected to the subpixels SP included in the display panel 160.

The display panel 160 includes the subpixels SP arranged in a matrix form. The subpixels SP include red subpixels, green subpixels, and blue subpixels. The subpixels SP may further include white subpixels, if necessary or desired. When the display panel 160 includes the white subpixels, in some embodiments, a light emitting layer of each subpixel SP does not emit any one of the red, green, or blue lights, but does emit white light. In this instance, the white light may be converted into red, green, and blue light using red, green, and blue color filters. However, the white subpixels emit white light without the conversion.

The sensing circuit unit 140 measures a threshold voltage of a driving transistor included in each of the subpixels SP of the display panel 160 and provides compensation data Comp Data capable of compensating for the data signal DATA. When the sensing circuit unit 140 measures the threshold voltage of the driving transistor included in each subpixel SP and provides the compensation data Comp Data, the sensing circuit unit 140 supplies an initialization voltage through a reference line of the subpixel SP of the display panel 160 and senses the threshold voltage of the driving transistor through a sensing transistor of the subpixel SP.

Problem of a compensation method using a sensing circuit unit of a comparative example is described below.

Figure 2:
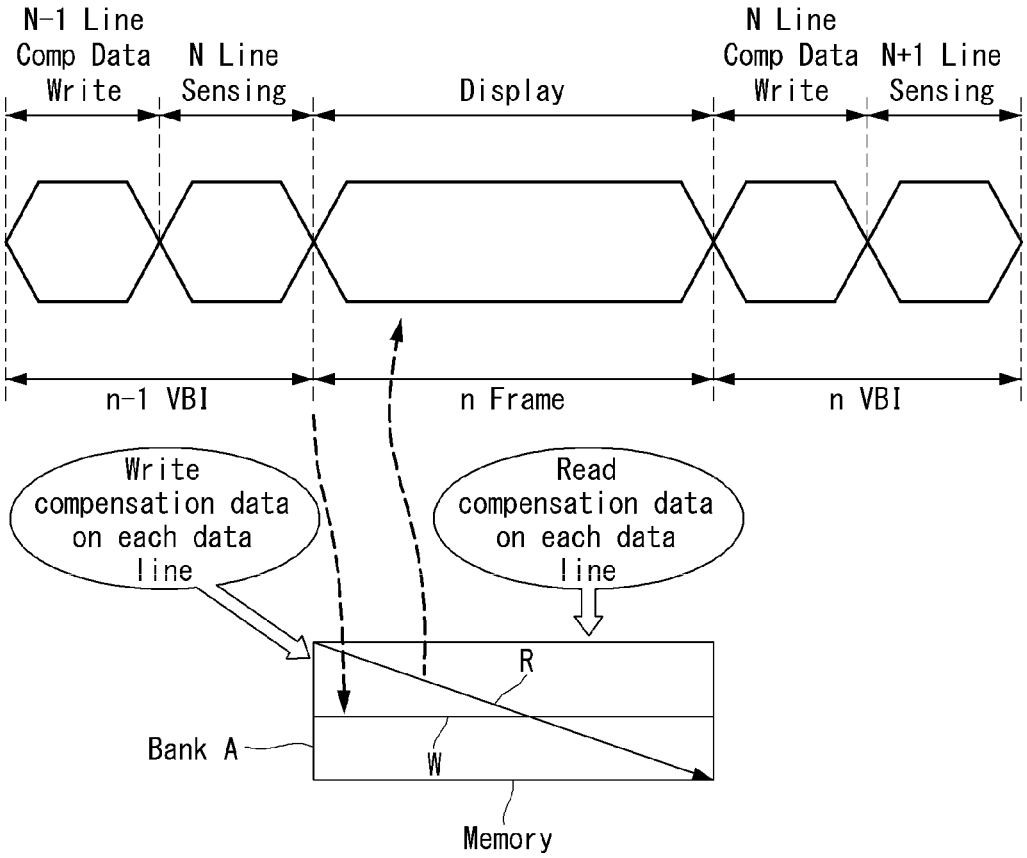
FIG. 2 illustrates a compensation method using a sensing circuit unit of a comparative example.
Figure 3:
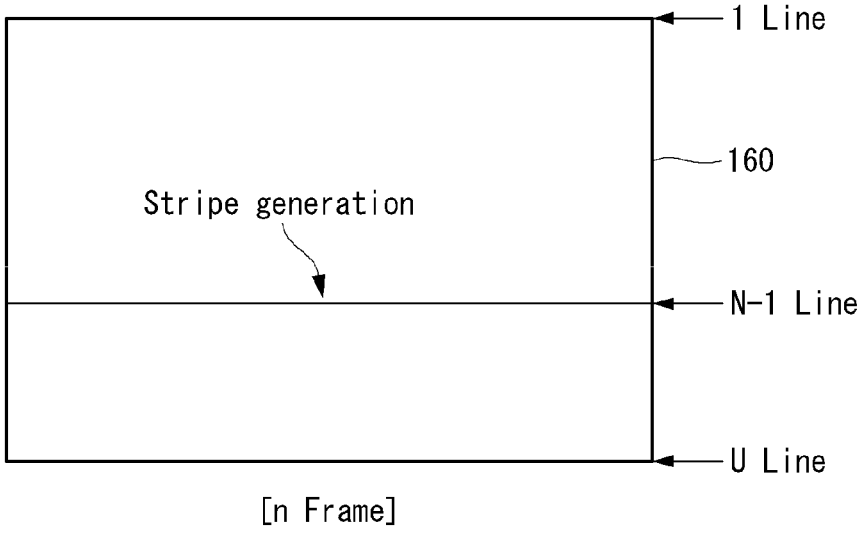
FIG. 3 illustrates problem of a compensation method using a sensing circuit unit of a comparative example.

FIG. 2 illustrates a compensation method using a sensing circuit unit of a comparative example. FIG. 3 illustrates problem of the compensation method using the sensing circuit unit of the comparative example.

When the organic light emitting display is used for a long time, characteristics (including a threshold voltage, a current mobility, etc.) of the driving transistor included in the subpixel change. Therefore, various problems including a reduction in life span of an organic light emitting element, etc. are generated due to a reduction in a driving current over time. Hence, an organic light emitting display according to the comparative example implements a real time compensation algorithm capable of compensating for changes in the characteristics of the driving transistor included in the subpixel in real time by forming a sensing circuit unit inside the organic light emitting display.

The compensation method according to the comparative example compares a reference value stored in a memory with a sensing value sensed in a blank period before the organic light emitting display is shipped, and then compensates for a difference between the reference value and the sensing value during a display period of a next frame.

The compensation method according to the comparative example performs an initial compensation operation when the organic light emitting display is turned on, thereby compensating for changes in the characteristics of the driving transistor included in the subpixel. However, when there is a large difference between the reference value, which is initially set, and the sensing value, the compensation method according to the comparative example cannot compensate for the large difference. Thus, the compensation method according to the comparative example has to compensate for a non-compensated portion in real time during a drive of the organic light emitting display.

However, as shown in FIG. 2, the compensation method according to the comparative example performs a process "N−1 Line Comp Data Write" for writing previous compensation data and a process "N Line Sensing" for sensing a selected line during one blank period 'n−1 VBI'. In this instance, a sensing value (for example, "N Line Sensing") of only one line may be obtained during the one blank period 'n−1 VBI'. The compensation method according to the comparative example performs a process 'W' for writing the sensing value, which is sensed during the blank period 'n−1 VBI', and a process 'R' for reading compensation data, which will be applied in a current frame, through only one bank 'A' defined in the memory.

Because of this, the compensation method according to the comparative example generates an interference between previous compensation data and new compensation data. Further, the compensation method according to the comparative example compensates for only the selected line and does not compensate for non-selected remaining lines. Therefore, there is a luminance difference between the selected line and the non-selected remaining lines. The luminance difference appears as a stripe along a horizontal line as shown in FIG. 3. Further, because the compensation method according to the comparative example obtains a sensing value of only one line, the line being selected in a random manner, during one black period. The horizontal stripe is thus generated in a random portion of the display panel 160.

To solve the above-described problem, the embodiment of the invention changes a sensing and compensation method from the base of line to the base of surface, so as to remove the horizontal stripe randomly appearing when the real time compensation algorithm is used. This is described in detail below.

Figure 4:
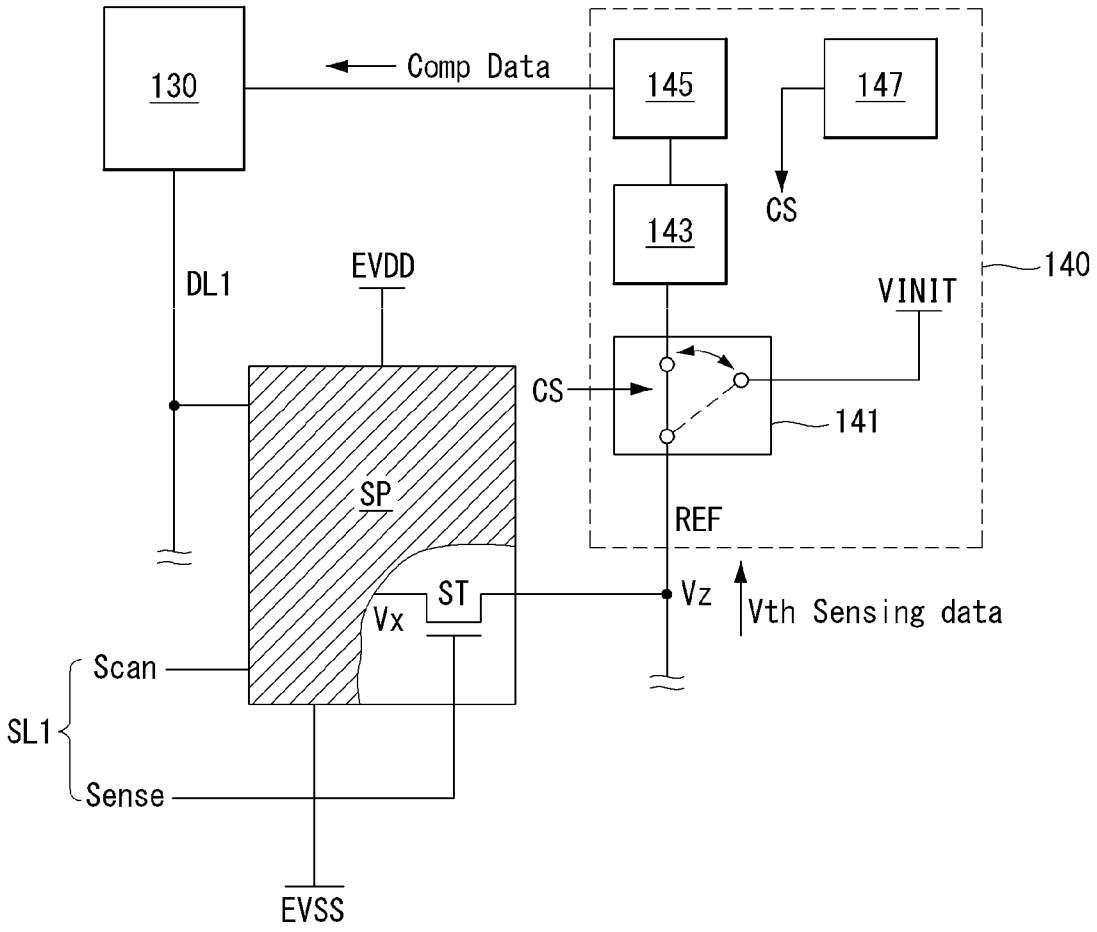
FIG. 4 shows an example of a partial configuration of a device according to an embodiment of the disclosure.
Figure 5:
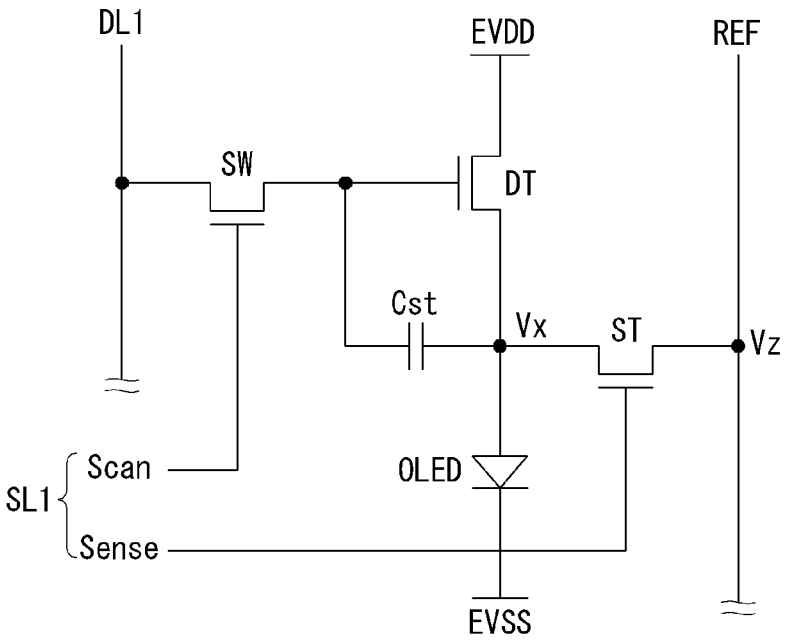
FIG. 5 shows an example of circuit configuration of a subpixel shown in FIG. 4.
Figure 6:
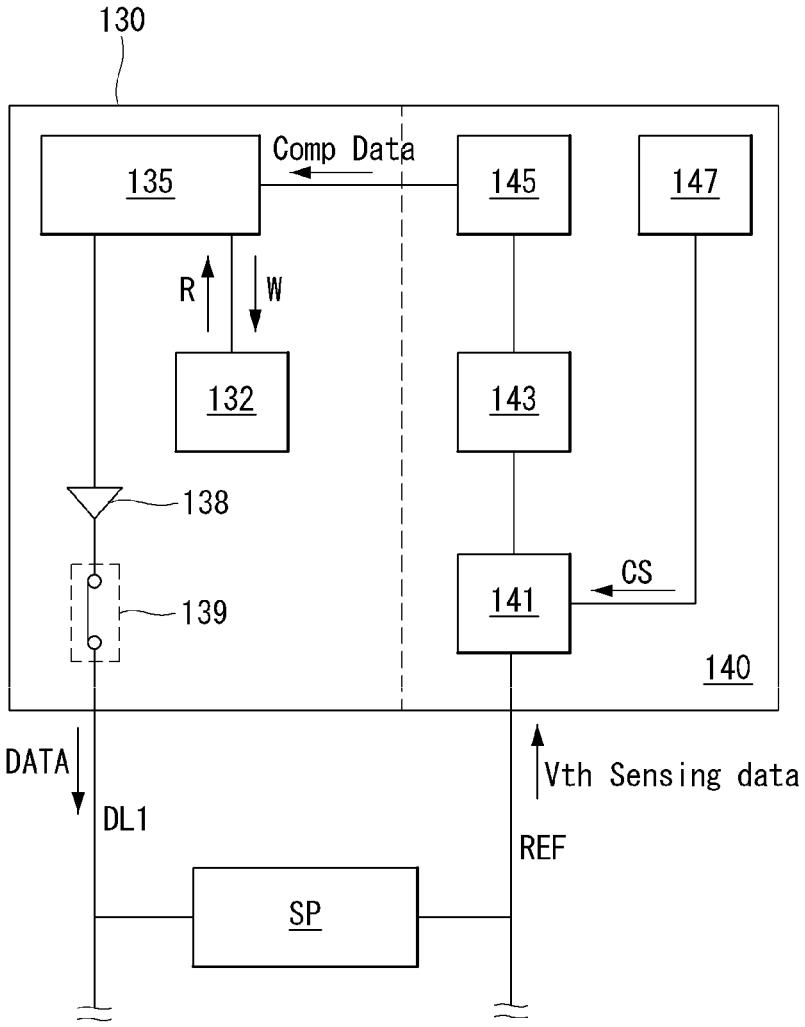
FIG. 6 shows a modification of partial configuration of a device according to an embodiment of the disclosure.

FIG. 4 shows an example of partial configuration of a device according to an embodiment. FIG. 5 shows an example of circuit configuration of a subpixel shown in FIG. 4. FIG. 6 shows a modification of partial configuration of the device according to the embodiment of the invention.

As shown in FIGS. 4 and 5, the organic light emitting display according to the embodiment includes the data driver 130, the sensing circuit unit 140, and the subpixels SP. Each subpixel SP includes a storage capacitor, a switching transistor, a driving transistor, a sensor transistor ST, and an organic light emitting diode.

Functions of the components included in the subpixel SP are briefly described below.

The storage capacitor functions to store the data signal as a data voltage. The switching transistor functions as a switch so as to store the data voltage in the storage capacitor. The driving transistor functions to supply a driving current to the organic light emitting diode. The sensor transistor ST functions to connect a node for sensing characteristics of the driving transistor. The organic light emitting diode functions to emit light.

The subpixel SP is connected to two or more scan lines Scan and Sense and one data line DL1 When a first scan signal is supplied to the subpixel SP through a first scan line 'Scan', the subpixel SP operates so that the data signal output from the data driver 130 is stored in the storage capacitor. When a second scan signal is supplied to the subpixel SP through a second scan line 'Sense', the subpixel SP performs a sensing operation using the sensing circuit unit 140. A reference line REF is formed between a sensing node Vz of the sensor transistor ST of the subpixel SP and the sensing circuit unit 140. The sensor transistor ST is connected to a source node Vx of the driving transistor of the subpixel SP.

As shown in FIG. 5, the subpixel SP includes a switching transistor SW, a driving transistor DT, a storage capacitor Cst, an organic light emitting diode OLED, and a sensor transistor ST. In the embodiment disclosed herein, the transistors SW, DT, and ST of the subpixel SP are an N-type transistor as an example. An electrical connection relationship between the transistors SW, DT, and ST is described below.

A gate electrode of the switching transistor SW is connected to a first scan line 'Scan', a first electrode of the switching transistor SW is connected to a data line DL1, and a second electrode of the switching transistor SW is connected to a gate electrode of the driving transistor DT. The gate electrode of the driving transistor DT is connected to the second electrode of the switching transistor SW, a drain electrode of the driving transistor DT is connected to a first potential voltage line EVDD, and a source electrode of the driving transistor DT is connected to an anode electrode of the organic light emitting diode OLED. One terminal of the storage capacitor Cst is connected to the gate electrode of the driving transistor DT, and the other terminal of the storage capacitor Cst is connected to the source electrode of the driving transistor DT. The anode electrode of the organic light emitting diode OLED is connected to the source electrode of the driving transistor DT, and a cathode electrode of the organic light emitting diode OLED is connected to a second potential voltage line EVSS. A gate electrode of the sensor transistor ST is connected to a second scan line 'Sense', a second electrode of the sensor transistor ST is connected to the source electrode of the driving transistor DT, and a first electrode of the sensor transistor ST is connected to a reference line REF.

The circuit configuration of the subpixel SP disclosed herein is merely an example, and the disclosure is not limited thereto. For example, at least one of the transistors SW, DT, and ST of the subpixel SP may be not the N-type transistor but a P-type transistor. The subpixel SP may further include a transistor or a capacitor performing other function in addition to the transistors SW, DT, and ST.

The sensing circuit unit 140 may include a first circuit unit 141 for converting a voltage of the reference line REF into a pulse voltage, a second circuit unit 143 for outputting the pulse voltage converted by the first circuit unit 141 as a step voltage, a third circuit unit 145 for converting the step voltage output by the second circuit unit 143 into a digital voltage, and a fourth circuit unit 147 for outputting a switching control signal CS during a blank period. The above configuration of the sensing circuit unit 140 is merely an example, and the disclosure is not limited thereto. For example, the second and third circuit units 143 and 145 may be integrated into one circuit unit. Further, the integrated circuit unit may convert an analog voltage sensed through the reference line REF into a digital voltage and may output the digital voltage, thereby implementing simple configuration thereof.

The first circuit unit 141 senses a threshold voltage of the driving transistor through the reference line REF and obtains a sensing value 'Vth Sensing data'. The first circuit unit 141 performs a switching operation, so that an initialization voltage supplied through an initialization voltage terminal VINIT is supplied to the reference line REF or a voltage of the reference line REF is converted into a pulse voltage in response to the switching control signal CS output from the fourth circuit unit 147. For this, the first circuit unit 141 may include N (where N is a natural number) switching circuits for electrically connecting an output terminal of the initialization voltage terminal VINIT to the reference line REF or electrically connecting an input terminal of the second circuit unit 143 to the reference line REF in response to the switching control signal CS, and a passive element. The passive element may function to increase stability and uniformity of the voltage input or output through the input terminal of the second circuit unit 143 and the output terminal of the initialization voltage terminal VINIT. Examples of the passive element may include a resistor and a capacitor. The passive element may be omitted depending on configuration and performance of the circuit unit, if necessary or desired.

The second circuit unit 143 includes a charge pump circuit, which adds up an input voltage and steps up an output voltage so that the pulse voltage converted by the switching operation of the first circuit unit 141 is output as the step voltage. The above-described configuration of the second circuit unit 143 reduces a noise (for example, a resistance component and a capacitance component) generated in the reference line REF during a sensing operation.

The third circuit unit 145 includes an analog-to-digital converter, so that the analog step voltage output by the second circuit unit 143 is converted into the digital voltage. The third circuit unit 145 converts the analog step voltage into the digital step voltage and also provides the compensation data Comp Data capable of compensating for the data signal based on the step voltage. The third circuit unit 145 may directly provide the compensation data Comp Data capable of determining a compensation level through various calculations, or may indirectly provide only a difference based on the step voltage.

The fourth circuit unit 147 outputs the switching control signal CS for controlling the switching operation (or sensing operation) of the first circuit unit 141. The fourth circuit unit 147 outputs the switching control signal CS at a start time point and an end time point of a vertical blank period positioned between frames. The fourth circuit unit 147 outputs the switching control signal CS for activating the switching operation of the first circuit unit 141 when the vertical blank period starts, and outputs the switching control signal CS for inactivating the switching operation of the first circuit unit 141 when the vertical blank period ends. When the switching operation of the first circuit unit 141 is activated, the fourth circuit unit 147 operates in a sensing start mode. On the other hand, when the switching operation of the first circuit unit 141 is inactivated, the fourth circuit unit 147 operates in a sensing standby mode.

As described above, the characteristics (including the threshold voltage, the current mobility, etc.) of the driving transistor included in the subpixel SP of the display panel change over time due to an internal or external environment. Because of this, the sensing circuit unit 140 senses the characteristics of the driving transistor and provides the compensation data Comp Data capable of compensating for the data signal. The data driver 130 compensates for and outputs the data signal based on the compensation data Comp Data received from the sensing circuit unit 140.

Although illustrated separately or as distinct components in FIG. 4, in alternative embodiments, the data driver 130 itself may include the sensing circuit unit 140 (as described with reference to FIG. 6 below).

As shown in FIG. 6, in some embodiments, the data driver 130 includes the sensing circuit unit 140. In such embodiments, the data driver 130 includes a memory 132, a data signal compensation unit 135, a data signal conversion unit 138, a data signal output unit 139, and the sensing circuit unit 140. Sensing circuit unit 140 of FIG. 6 optionally shares one or more components (e.g., first circuit unit 141, second circuit unit 143, third circuit unit 145, fourth circuit unit 147 as illustrated in FIG. 6) and optionally shares one or more attributes of sensing unit 140 described with reference to FIG. 4.

The memory 132 is positioned inside or outside the data driver 130 and has at least two banks. The compensation data Comp Data is written to the memory 132. The compensation data Comp Data written to the memory 132 is recorded or read by the data signal compensation unit 135.

The data signal compensation unit 135 compensates for the data signal DATA (provided to the SP via DL1) based on the compensation data Comp Data received from the sensing circuit unit 140. Comp Data is generated by the sensing unit 140 based on the Vth sensing data received by the sensing unit 140 from the SP. The data signal compensation unit 135 reads (R) previous compensation data and writes (W) new compensation data through the different banks of the memory 132. For this, the data signal compensation unit 135 occupies the first and second banks of the memory 132, and reads (R) the previous compensation data and writes (W) the new compensation data through the first and second banks.

The data signal conversion unit 138 converts the data signal DATA of digital type into the data signal DATA of analog type. The data signal conversion unit 138 converts the data signal DATA compensated by the data signal compensation unit 135 or the non-compensated data signal DATA based on the gamma reference voltage. The data signal output unit 139 outputs the data signal DATA.

A sensing method using the sensing circuit unit 140 of the organic light emitting display according to some embodiments is described in detail below.

Figure 7:
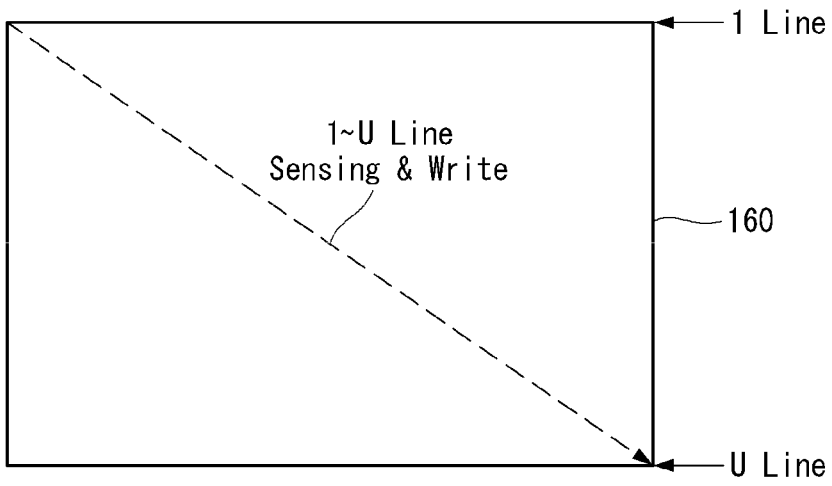
FIG. 7 illustrates a sensing method on a display panel according to an embodiment of the disclosure.
Figure 8:
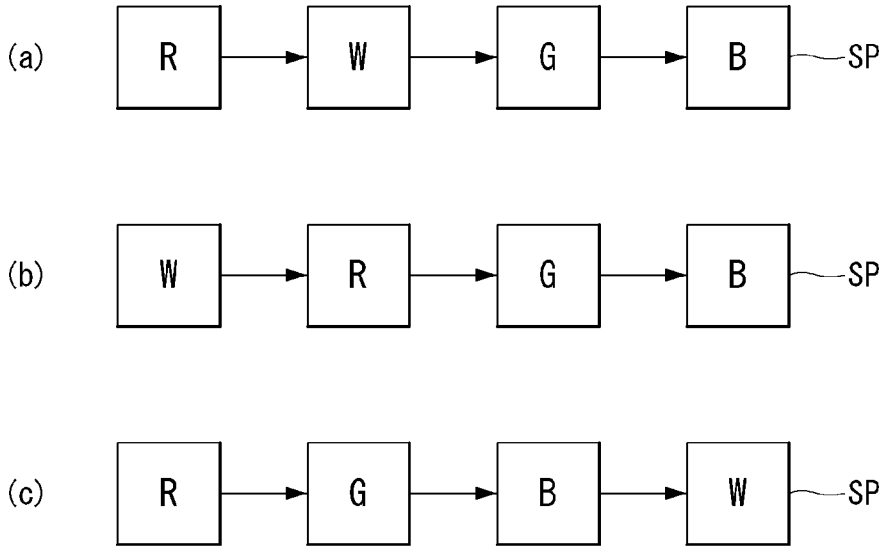
FIG. 8 illustrates the sensing order of subpixels formed on a display panel according to an embodiment of the disclosure.
Figure 9:
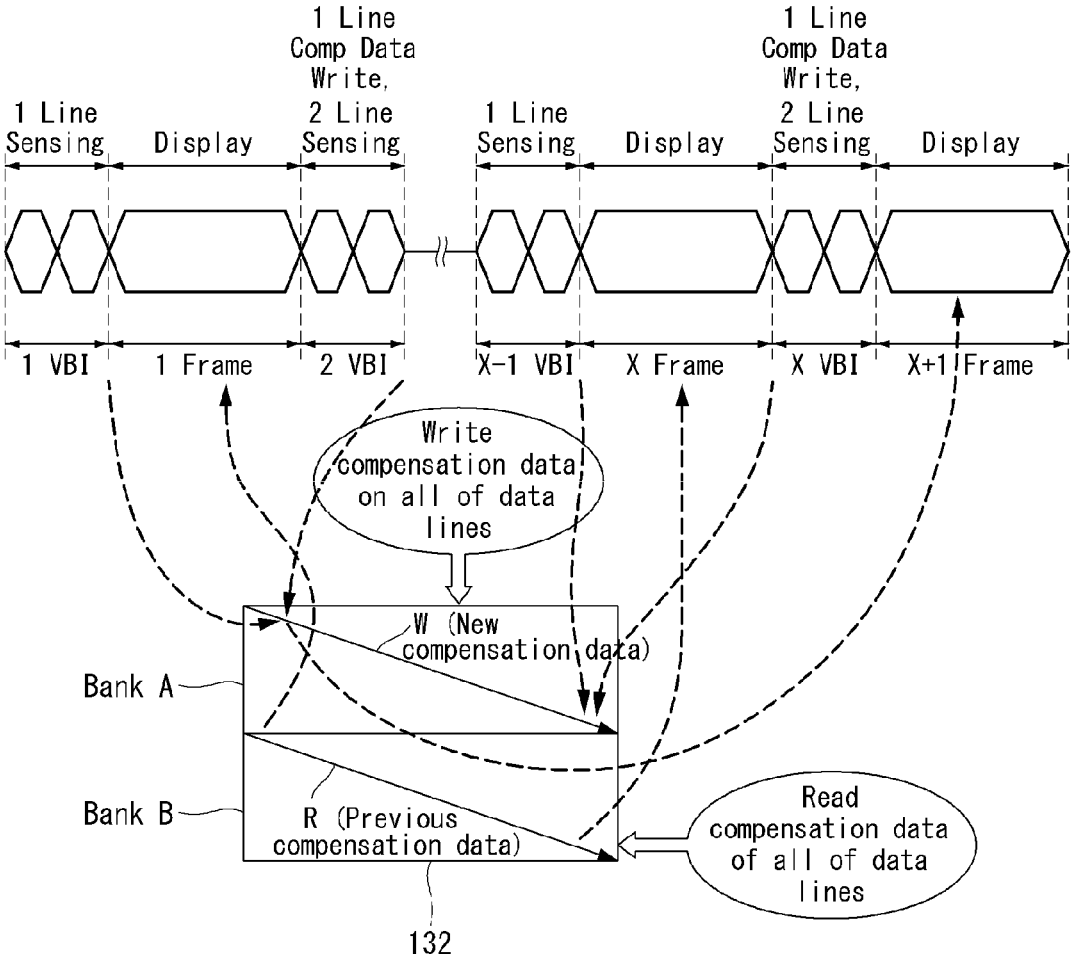
FIG. 9 illustrates a concept of writing and reading data through the separation of banks of a memory according to an embodiment of the disclosure.
Figure 10:
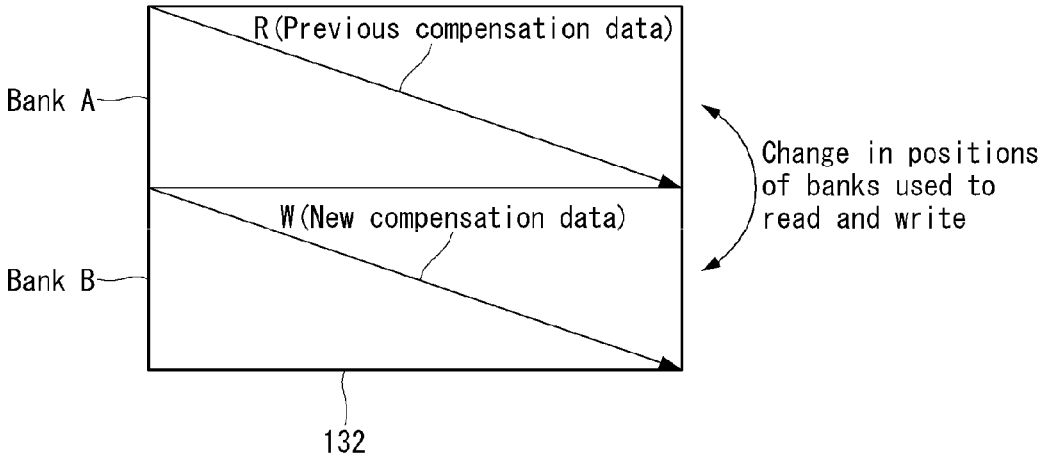
FIG. 10 illustrates a concept of writing and reading data through the switching of banks of a memory according to an embodiment of the disclosure.
Figure 11:
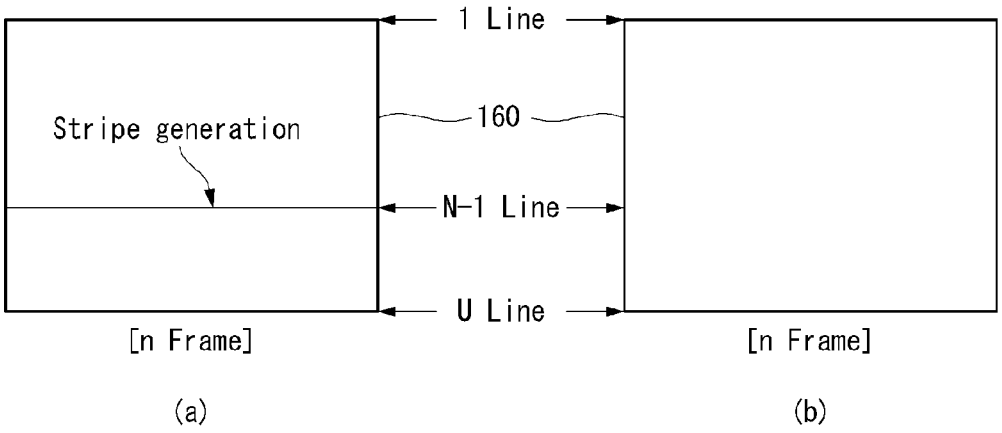
FIG. 11 illustrates an improvement effect in an embodiment of the disclosure.
Figure 12:
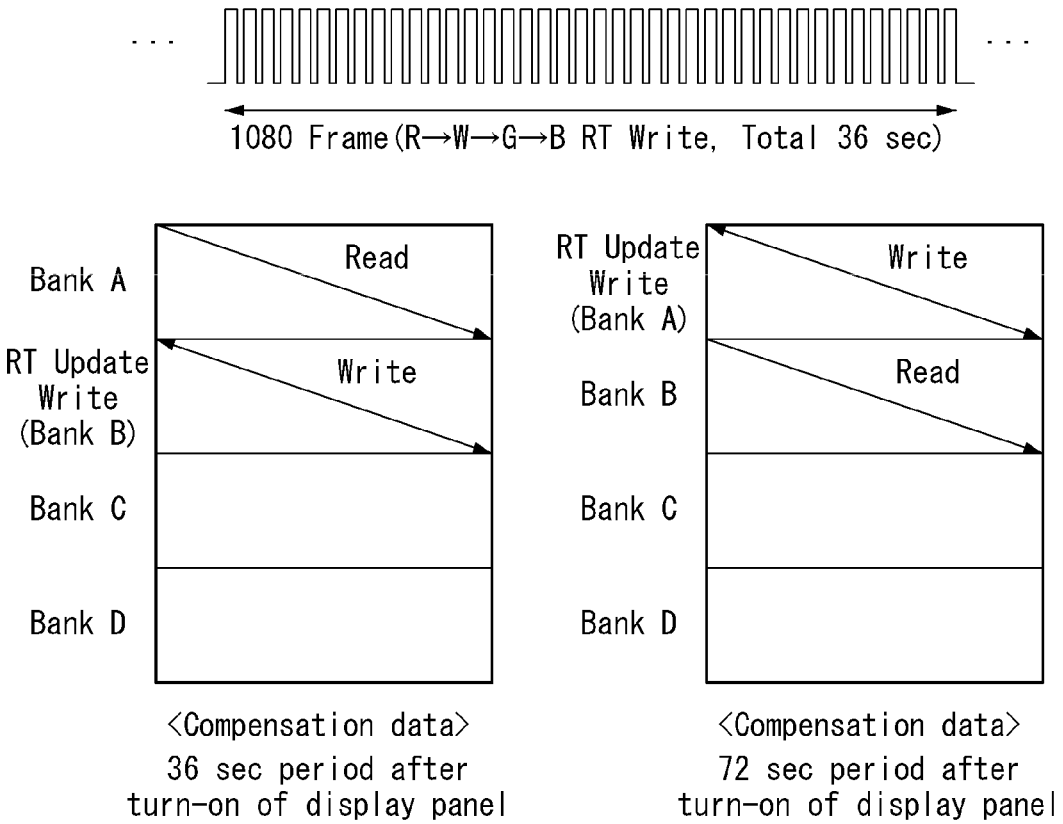
FIG. 12 illustrates time required to sense and compensate when an embodiment of the disclosure is applied to 55-inch organic light emitting display.

FIG. 7 illustrates a sensing method on the display panel according to the embodiment of the invention. FIG. 8 illustrates the sensing order of the subpixels formed on the display panel according to the embodiment of the invention. FIG. 9 illustrates a concept of writing and reading data through the separation of the banks of the memory according to the embodiment of the invention. FIG. 10 illustrates a concept of writing and reading data through the switching of the banks of the memory according to the embodiment of the invention. FIG. 11 illustrates an improvement effect in the embodiment of the invention. FIG. 12 illustrates time required to sense and compensate when the embodiment of the invention is applied to 55-inch organic light emitting display.

As shown in FIGS. 7 to 10, the sensing circuit unit 140 and the data signal compensation unit 135 according to some embodiments are mutually driven, so as to sense and compensate for characteristics of the display panel 160.

Referring to FIG. 7, the sensing circuit unit 140 senses all of a first line '1 Line' to a last line 'U Line' of the display panel 160 during vertical blank periods 1VBI to xVBI except a display period of an image displayed on the display panel 160 to obtain a sensing value 'Vth Sensing data' corresponding to the threshold voltage of the driving transistors included in all of the subpixels.

As shown in sequence (a) of FIG. 8, the sensing circuit unit 140 may obtain the sensing value 'Vth Sensing data' corresponding to the threshold voltage of the driving transistors included in the red (R), white (W), green (G), and blue (B) subpixels SP in the order named (R→W→G→B). Alternatively, as shown in sequence (b) of FIG. 8, the sensing circuit unit 140 may obtain the sensing value 'Vth Sensing data' corresponding to the threshold voltage of the driving transistors included in the white (W), red (R), green (G), and blue (B) subpixels SP in the order named (W→R→G→B). Alternatively, as shown in sequence (c) of FIG. 8, the sensing circuit unit 140 may obtain the sensing value 'Vth Sensing data' corresponding to the threshold voltage of the driving transistors included in the red (R), green (G), blue (B), and white (W) subpixels SP in the order named (R→G→B→W).

The sensing order of the subpixels shown in FIG. 8 is merely an example on the assumption that the display panel 160 includes the red (R), green (G), blue (B), and white (W) subpixels SP, and the embodiments are not limited thereto. Although not shown, when the display panel 160 includes the red (R), green (G), and blue (B) subpixels SP, the sensing circuit unit 140 may obtain the sensing value 'Vth Sensing data' corresponding to the threshold voltage of the driving transistors included in the red (R), green (G), and blue (B) subpixels SP in the order named (R→G→B).

When the sensing operation of all of the first line '1 Line' to the last line 'U Line' of the display panel 160 is completed by the sensing circuit unit 140, the data signal compensation unit 135 (of FIG. 6, for instance) writes the new compensation data, which is provided through the sensing operation, to the memory 132 (of FIG. 6, for instance) during the display period of the image displayed on the display panel 160. The data signal compensation unit 135 reads the previous compensation data for the compensation of the data signal during the display period of the image displayed on the display panel 160.

Referring now to FIG. 9, the sensing operation of the first line '1 Line' of the display panel 160 is performed through the mutual drive between the sensing circuit unit 140 and the data signal compensation unit 135 during the vertical blank period 1VBI. A compensation level of the first line '1 Line' of the display panel 160 (illustrated in FIG. 7) is calculated during the vertical blank period 2VBI. Further, during the vertical blank period 2VBI, the compensation data Comp Data of the first line '1 Line' obtained through the calculation is written, and the sensing operation of the second line '2 Line' of the display panel 160 is performed. The sensing value 'Vth Sensing data' corresponding to the threshold voltage of the driving transistors included in all of the subpixels SP is obtained through the above-described processes, and the compensation data Comp Data of each line of the display panel 160 is provided and written in each of the vertical blank periods 1VBI to xVBI.

The sensing circuit unit 140 completes the sensing operation of all of the first line '1 Line' to the last line 'U Line' of the display panel 160 (illustrated in FIG. 7) and then may provide the compensation data of all of the sensing values during the display period of the image or the vertical blank period VBI. However, the method for performing the sensing operation and providing the compensation data in each vertical blank period has an advantage of timely applying the compensation data, as compared with the method for performing the sensing operation of all of the first line '1 Line' to the last line 'U Line' of the display panel 160 and then providing the compensation data.

The data signal compensation unit 135 occupies a first bank 'Bank A' and a second bank 'Bank B' of the memory 132, and reads (R) the previous compensation data and writes (W) the new compensation data through the first and second banks.

For example, the data signal compensation unit 135 reads the previous compensation data through the second bank 'Bank B' of the memory 132 during the display period belonging to a period, in which the sensing circuit unit 140 performs the sensing operation of all of the first line '1 Line' to the last line 'U Line' of the display panel 160, and compensates for the data signal based on the read compensation data. However, when the sensing operation of all of the first line '1 Line' to the last line 'U Line' of the display panel 160 is completed by the sensing circuit unit 140 (for example, when the sensing operation is completed in the vertical blank period xVBI), the data signal compensation unit 135 compensates for the data signal, which will be applied in a (x+1)th frame, through the first bank 'Bank A' of the memory 132.

The data signal compensation unit 135 alternately uses the first bank 'Bank A' and the second bank 'Bank B' of the memory 132. Namely, the data signal compensation unit 135 changes a position of the bank used to read and a position of the bank used to write, so that the previous compensation data and the new compensation data are individually stored in the different banks of the memory 132.

For example, as shown in FIG. 9, the second bank 'Bank B' of the memory 132 is used to read the previous compensation data, and the first bank 'Bank A' of the memory 132 is used to write the new compensation data. However, after predetermined frame periods passed, new Nth compensation data is changed to previous (N−1)th compensation data, and new (N+1)th compensation data is provided through the sensing and calculation process. Thus, as shown in FIG. 10, the second bank 'Bank B' of the memory 132 is used to write the new compensation data, and the first bank 'Bank A' of the memory 132 is used to read the previous compensation data. In other words, the storage position of the previous compensation data and the storage position of the new compensation data are alternately changed in the banks of the memory 132.

As described above, when the sensing value 'Vth Sensing data' corresponding to the threshold voltage of the driving transistors included in all of the subpixels is obtained, and the compensation data of the sensing value 'Vth Sensing data' is provided in each vertical blank period, the data signal of not one line but all of the lines may be compensated. Further, each time the new compensation data is provided, the positions of the banks of the memory 132 used to read and write the compensation data are changed. Hence, the interference between the previous compensation data and the new compensation data may be prevented.

Accordingly, when the circuit according to these embodiments is configured and the compensation method disclosed herein is performed, appearance of the horizontal line (shown in FIG. 11) on the display panel 160 at a random location, is eliminated when the real time compensation algorithm is used. Further, the interference between the previous compensation data and the new compensation data is prevented. In FIG. 11, (a) shows the screen in the Nth frame when the real time compensation algorithm according to the comparative example is used, and (b) shows the screen in the Nth frame when the real time compensation algorithm according to some embodiments.

FIG. 12 illustrates time required to sense and compensate when the embodiment is applied to 55-inch organic light emitting display having a display panel including red (R), white (W), green (G), and blue (B) subpixels.

The sensing circuit unit 140 senses one line in each frame, and the data signal compensation unit 135 provides the compensation data of one line in each frame. The number of lines of a display panel including red (R), white (W), green (G), and blue (B) subpixels is 1080. 1080 frames are required to sense all of the lines of the display panel and provide compensation data of all of the lines. The display panel 160 displays 120 frames per second. 1080 frames divided by 120 frames is 9 seconds. The display panel includes four colors of subpixels. Thus, time required to sense and compensate the display panel is calculated to be 36 seconds by multiplying 9 seconds by four.

A method for driving the organic light emitting display according to the embodiment of the invention is described below.

The method for driving the organic light emitting display according to the embodiment of the invention uses the external compensation circuit shown in FIGS. 4 to 12, so as to prevent changes in the characteristics (including the threshold voltage, the current mobility, etc.) of the driving transistors included in the subpixels when the organic light emitting display is used for a long time. Thus, the method for driving the organic light emitting display according to some embodiments is described with reference to FIGS. 4 to 12 for the sake of brevity and ease of reading.

Figure 13:
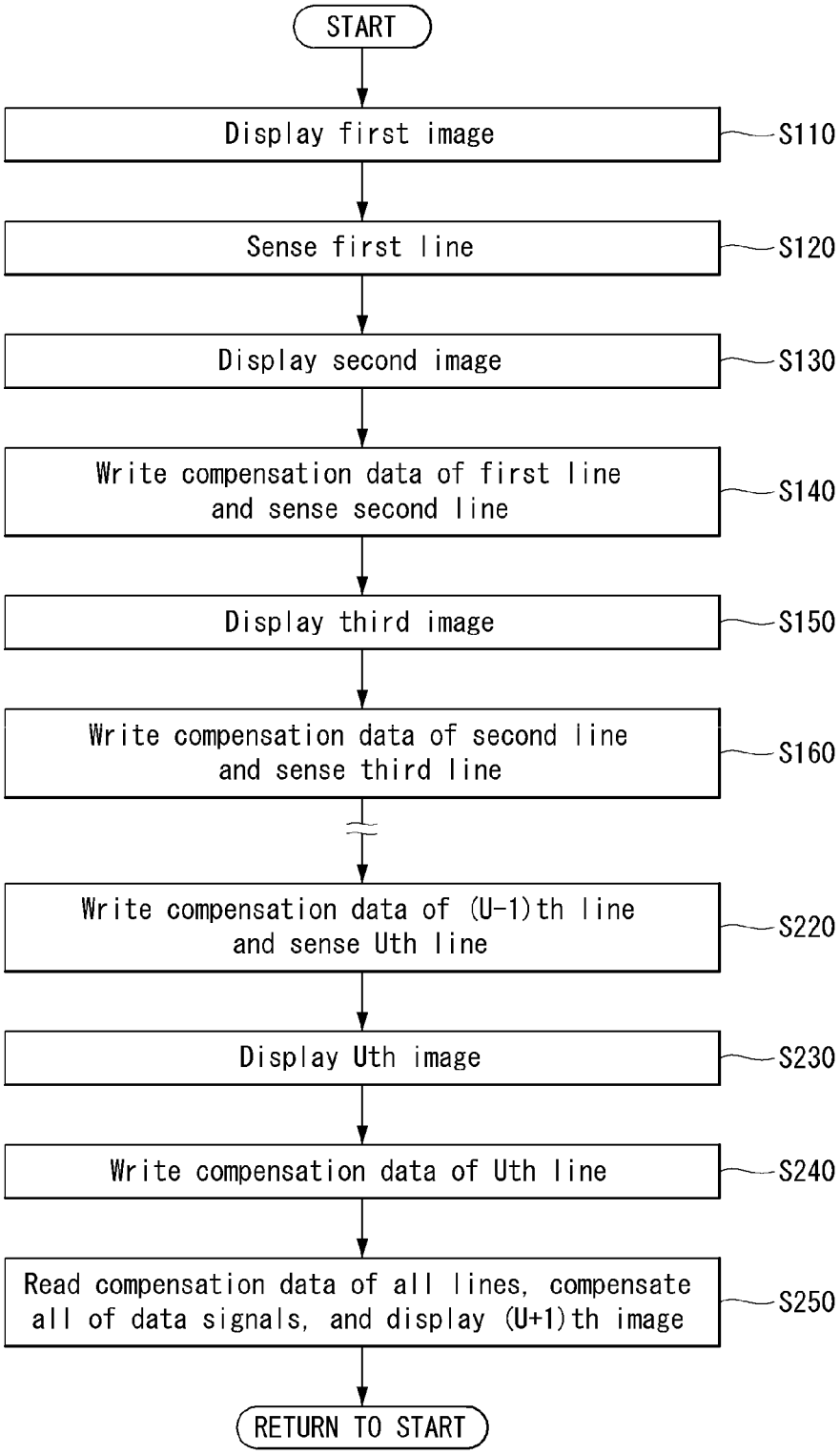
FIG. 13 is a flow chart illustrating a method for driving an organic light emitting display according to an embodiment of the disclosure.

FIG. 13 is a flow chart illustrating a method for driving the organic light emitting display according to the embodiment of the invention.

The method for driving the organic light emitting display according to the embodiment of the invention includes a step of supplying the data signal to the display panel 160 and displaying an image on the display panel 160; a step of measuring a threshold voltage of at least one driving transistor included in the display panel 160, providing compensation data, individually writing previous compensation data and new compensation data to at least two banks of the memory, and reading the previous compensation data and the new compensation; and reading the previous compensation data during a display period of the image displayed on the display panel 160 and compensating for the data signal which will be now supplied.

The method for driving the organic light emitting display according to the embodiment of the invention is sequentially described from the display period of the image below.

As shown in FIG. 13, a first image is displayed in step S110. After the first image is displayed, a first line is sensed during a vertical blank period in step S120. A second image is displayed in step S130. After the second image is displayed, compensation data of the first line is written to the second bank 'Bank B' of the memory 132 (e.g., as shown in FIG. 10) and a second line is sensed during the vertical blank period in step S140. A third image is displayed in step S150. After the third image is displayed, compensation data of the second line is written to the second bank 'Bank B' of the memory 132 (e.g., as shown in FIG. 10) and a third line is sensed during the vertical blank period in step S160. Analogous steps to those describe above with reference to S110-S160 are optionally repeated for multiple images and lines (such as a fourth image, fifth image, and so on; fourth line, fifth line, and so on), as indicated by the break or discontinuity in the flowchart between steps S160 and S220. According to the above-described driving method, during the vertical blank period, compensation data of a (U−1)th line is written to the second bank 'Bank B' of the memory 132, and an Uth line is sensed in step S220. An Uth image is displayed in step S230. During the vertical blank period, compensation data of the last line (i.e., the Uth line) of the display panel 160 is written to the second bank 'Bank B' of the memory 132 in step S240. Compensation data of all of the lines of the display panel 160 is read, all of the data signals are compensated, and a (U+1)th image is displayed in step S250.

According to the above-described driving method, when the sensing operation is performed, the compensation data is provided, and the image is displayed during the vertical blank period, the previous compensation data and the new compensation data are continuously generated, written, and read. In this instance, the embodiment of the invention uses the following method, so as to prevent the interference between the previous compensation data and the new compensation data.

Figure 14:
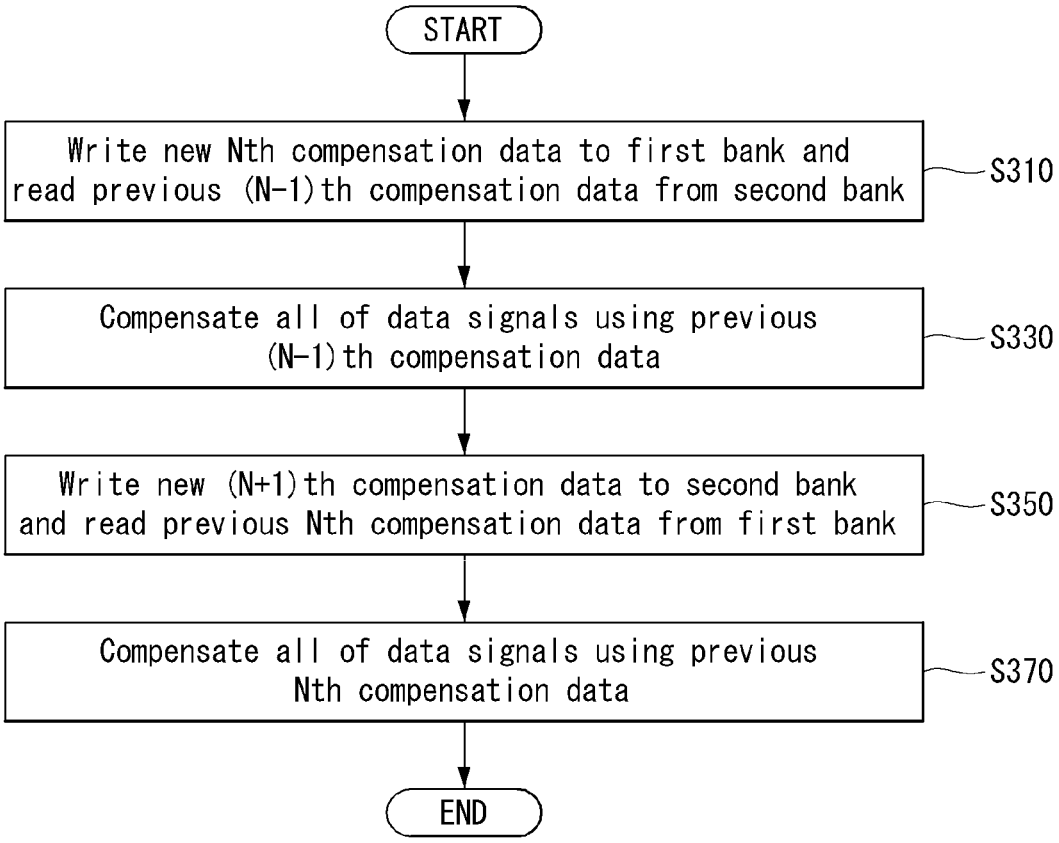
FIG. 14 is a flow chart illustrating a method for changing, writing, and reading previous compensation data and new compensation data to banks of a memory.

FIG. 14 is a flow chart illustrating a method for changing, writing, and reading previous compensation data and new compensation data to the banks of the memory.

The method for changing, writing, and reading previous compensation data and new compensation data to the banks of the memory is described below.

Nth compensation data, which is newly generated, is written to the first bank 'Bank A' of the memory 132, and previous (N−1)th compensation data is read from the second bank Bank B' of the memory 132 in step S310. All of the data signals are compensated using the previous (N−1)th compensation data in step S330. New (N+1)th compensation data is written to the second bank 'Bank B' of the memory 132, and the previous Nth compensation data is read from the first bank 'Bank A' of the memory 132 in step S350. All of the data signals are compensated using the previous Nth compensation data in step S370.

As can be seen from FIG. 14, a position, at which the previous compensation data is read, and a position, at which the new compensation data is written, are changed each time compensation data is newly provided. Hence, when the previous compensation data and the new compensation data is read or written through the banks of the memory 132, the interference between the previous compensation data and the new compensation data is prevented.

As described above, the embodiment of the invention changes the compensation time point in real time to compensate for the data signals of all of the lines, and prevents the interference between the previous compensation data and the new compensation data, thereby solving the problems such as, the image sticking, screen stains, and a reduction in life span, generated when the organic light emitting display is used for a long time. Further, the embodiment of the invention may improve the image quality of the organic light emitting display.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An organic light emitting display comprising:

a display panel;

a data driver configured to supply a data signal to the display panel;

a memory positioned inside or outside the data driver, the memory including at least two banks; and a sensing circuit unit configured to:

measure a threshold voltage of at least one driving transistor included in a subpixel positioned on one line of the display panel during a first vertical blank period during which an image is not displayed on the display panel, the first vertical blank period immediately preceding display of a first image on the display panel, and provide compensation data corresponding to the measured threshold voltage of the subpixel positioned on the one line of the display panel to the memory, the compensation data provided during a second vertical blank period during which the image is not displayed on the display panel, the second vertical blank period immediately following display of the first image, wherein the data driver separately reads previous compensation data and writes new compensation data provided by the sensing circuit unit in the at least two banks of the memory.

2. The organic light emitting display of claim 1, wherein the sensing circuit unit is configured to sense a first line to a last line of the display panel and is configured to provide corresponding compensation data during a display period of the image or during a vertical blank period.

3. The organic light emitting display of claim 1, wherein the data driver includes a data signal compensation unit, the data signal compensation unit configured to compensate for the data signal based on the compensation data, wherein the data signal compensation unit reads the previous compensation data from a first bank of the at least two banks of the memory and writes the new compensation data to a second bank of the at least two banks of the memory, wherein a position, at which the previous compensation data is read, and a position, at which the new compensation data is written, are changed each time compensation data is newly provided.

4. The organic light emitting display of claim 3, wherein the data signal compensation unit is configured to read the previous compensation data, so as to compensate for the data signal, to be supplied, during a period, in which an image is displayed on the display panel.

5. The organic light emitting display of claim 1, wherein the sensing circuit unit includes a circuit unit, the circuit unit configured to control a sensing operation for measuring the threshold voltage of the at least one driving transistor included in the display panel, wherein the circuit unit outputs a switching control signal, which activates the sensing operation, at a start time point and an end time point of a vertical blank period positioned between frames.

6. The organic light emitting display of claim 1, wherein when the sensing circuit unit is configured to measure the threshold voltage of the at least one driving transistor included in the display panel and is further configured to provide the compensation data, the sensing circuit unit supplying an initialization voltage through a reference line of a subpixel of the display panel and sensing the threshold voltage of the at least one driving transistor through a sensing transistor of the subpixel.

7. The organic light emitting display of claim 1 wherein the sensing unit is configured to measure threshold voltages of subpixels positioned in a second line of the display panel during the second vertical blank period, the second line adjacent to and distinct from the one line of the display panel.

8. A method for driving an organic light emitting display comprising:

supplying a data signal to a display panel and displaying an image on the display panel;

measuring, by a sensing circuit unit, a threshold voltage of at least one driving transistor included in the display panel during a first vertical blank period during which the image is not displayed on the display panel, providing compensation data corresponding to the measured threshold voltage of the at least one driving transistor to a memory during a second vertical blank period during which the image is not displayed on the display panel, and separately reading previous compensation data and writing new compensation data in at least two banks of the memory; and reading the previous compensation data and compensating for the data signal, to be supplied, during a period, during which the image is displayed on the display panel, wherein the first vertical blank period immediately precedes the display of a first image on the display panel and the second vertical blank period immediately follows the display of the first image.

9. The method of claim 8, further comprising:

measuring a threshold voltage of a driving transistor included in a subpixel positioned on one line of the display panel and providing compensation data during each vertical blank period, during which the image is not displayed on the display panel; and sensing a first line to a last line of the display panel and then providing corresponding compensation data during a display period of the image or during a vertical blank period.

10. The method of claim 8, wherein a position, at which the previous compensation data is read, and a position, at which the new compensation data is written, are changed each time compensation data is newly provided.

* * * * *